US009441333B2

(12) United States Patent
McIntosh

(10) Patent No.: US 9,441,333 B2
(45) Date of Patent: Sep. 13, 2016

(54) MODULAR RAMP SYSTEM

(71) Applicant: Philip McIntosh, Downpatrick (GB)

(72) Inventor: Philip McIntosh, Downpatrick (GB)

( * ) Notice: Subject to any disclaimer, the term of this patent is extended or adjusted under 35 U.S.C. 154(b) by 0 days.

(21) Appl. No.: 14/891,489

(22) PCT Filed: May 15, 2014

(86) PCT No.: PCT/EP2014/060029

§ 371 (c)(1),
(2) Date: Nov. 16, 2015

(87) PCT Pub. No.: WO2014/184325

PCT Pub. Date: Nov. 20, 2014

(65) Prior Publication Data

US 2016/0090699 A1 Mar. 31, 2016

(30) Foreign Application Priority Data

May 15, 2013 (GB) ..... 1308776.2

(51) Int. Cl.
*A63C 19/10* (2006.01)
*E01C 5/00* (2006.01)
*E01C 13/00* (2006.01)

(52) U.S. Cl.
CPC ..... *E01C 13/003* (2013.01); *A63C 19/10* (2013.01); *E01C 5/005* (2013.01); *A63C 2203/10* (2013.01)

(58) Field of Classification Search
CPC .. B65G 69/28; B65G 69/2811; B65G 69/30; A63C 19/00; A63C 19/10; A61G 3/06; A61G 3/061
USPC ..... 472/88, 89, 90; 14/69.5; 414/537, 921; 119/843
See application file for complete search history.

(56) References Cited

U.S. PATENT DOCUMENTS 4,285,514 A * 8/1981 Romero ..... A63C 19/10 14/69.5
2003/0213072 A1* 11/2003 Myrick ..... B60P 1/43 14/69.5
2007/0234491 A1 10/2007 Bailie

FOREIGN PATENT DOCUMENTS

DE 3726871 11/1988
EP 0067640 12/1982
WO 2005014129 2/2005

OTHER PUBLICATIONS

International Search Report Dated July 29, 2014.
International Preliminary Report on Patentability Dated May 27, 2015.
English Abstract of DE3726871.

* cited by examiner

*Primary Examiner* — Kien Nguyen
(74) *Attorney, Agent, or Firm* — Preston Smirman; Smirman IP Law, PLLC

(57) ABSTRACT

A modular ramp system comprising a plurality of panels assemblable to form a multi-sectional ramp deck and a collapsible load bearing arrangement for supporting each panel of the multi-sectional ramp deck at a predetermined distance off the ground. At least two of the panels having a correspondingly located connecting assembly locatable proximal to a leading edge and a trailing edge of the adjoining edges of two adjacent panels. The connecting assembly having an arrangement for enabling the main plane of the panels to enter into and out of alignment with one another to engage and disengage the multi-sectional ramp deck. The connecting assembly also having functionality for enabling relative movement of the panels when the main plane of the panels is out of alignment such that all panels are stackable one on another for stowage and/or transport.

28 Claims, 11 Drawing Sheets

MODULAR RAMP SYSTEM

CROSS-REFERENCE TO RELATED APPLICATION

The instant application is a national phase of PCT International Application No. PCT/EP2014/060029 filed May 15, 2014, and claims priority to GB Patent Application Serial No. 1308776.2 filed May 15, 2013, the entire specifications of both of which are expressly incorporated herein by reference.

The present invention relates to a collapsible ramp for the use in but not limited to sports such as skateboarding, BMX, rollerskating, in-line skating and motocross or similar recreational activities.

As traditional sports have evolved a growing number of sporting and recreational facilities are being developed which provide for skateboarders or the like. Many of these facilities have in-situ ramps to allow users to achieve vertical jumps and practice tricks for pleasure and/or competition. These ramps are typically solid and fixed structures, made up of a concrete or the like, or permanently installed wooden and metal structures or a combination of these materials.

For many would be practitioners of these sports, these recreational facilities are not geographical close to their residence, so the practice of these types of sports tends to be confined to practicing the sport on homemade ramps using any available materials to produce a ramp. This is often a difficult and time consuming process.

It is an object of the present invention to obviate or mitigate the problem of conventionally fixed ramp structures or the requirement of users to construct a temporary ramp, and to provide a ramp structure that can be quickly assembled and disassembled for transport by a single individual.

Accordingly, the present invention provides a modular ramp system comprising a plurality of panels assemblable to form a multi-sectional ramp deck, a collapsible load bearing means for supporting each panel of the multi-sectional ramp deck at a predetermined distance off the ground, at least two of the panels having a correspondingly located connecting means locatable proximal to a leading edge and a trailing edge of the adjoining edges of two adjacent panels, the connecting means having means for enabling the main plane of the panels to enter into and out of alignment with one another to engage and disengage the multi-sectional ramp deck, the connecting means also having means for enabling relative movement of the panels when the main plane of the panels is out of alignment such that all panels are stackable one on another for stowage and/or transport.

Advantageously, the adjustable connecting means allows a ramp system to be rigidly connected in an in use position but also allows a single person to easily move the separate panels of the ramp system into a stackable configuration so that the ramp occupies a much shorter overall lengthwise space allowing a single person to transport the ramp system on their back for example. This allows one person to take the ramp system on their back while cycling to the area where they want to utilise the ramp.

Further advantageously, in urban environments this invention is advantageous to allow users to create a ramp system comprising modular components that are combinable together and may be easily assembled for use and disassembled for storage. An example of this is whereby a user has a driveway at their home where the ramp may be assembled, but the user must be able to disassemble and store those components when the driveway is to be used for normal vehicle use. In a further example a user may wish to disassemble the ramp to transport to an area where space would not be a limiting factor such as a general recreational park etc and reassemble the ramp upon arrival at the chosen location.

Preferably, the connecting means maintains the connection between the two adjacent panels of the multi-sectional ramp deck at all times during the modular ramp systems expanded configuration and retracted stowage configuration.

Ideally, the connecting means enables the main plane of the panels to enter into and out of alignment with one another so that the leading edge and trailing edge of the adjoining edges of two adjacent panels are moved out of contact with each other. This provides engagement and disengagement of the multi-sectional ramp deck and enables relative movement of the panels such that the panels are stackable without the requirement to remove the connecting means.

Preferably, the connecting means enables relative movement of all of the edges of the panels once the main plane of adjoining panels are moved out of alignment such that all panels are stackable one on another for stowage and/or transport.

In one embodiment of the invention, the connecting means is provided by a sliding mechanism operable between adjacent panels.

Ideally, the sliding mechanism enables relative translational movement of adjacent panels.

Preferably, the sliding mechanism is integral to the individual panels.

In an alternative arrangement, the sliding mechanism is mechanically coupled to the panels.

Ideally, the sliding mechanism comprises protrusion means locateable on the sides of a panel and a correspondingly located elongate receiving channel locateable on the side of the adjacent panel.

Preferably, the elongate receiving channels guide the movement of the protrusion means such that all panels are stackable one on another in a nested configuration for stowage and/or transport.

Ideally, the connecting means comprises hinge connections.

In the most preferred embodiment of the invention, the connecting means comprises a pivotal coupling arrangement comprising a first member being couplable to a first panel and being pivotally coupled to a second member which is couplable to a second panel, the first member and the second member being axially adjustable relative to one another to allow the main plane of the adjacent panels to be moved into and out of alignment so as to allow relative rotation of the panels once the panels are moved out of alignment. This allows all panels to be stackable one on another for stowage while maintaining the connection of the panel's leading edge to the corresponding adjacent panel's trailing edge.

Preferably, the pivotal coupling arrangement enables the panels to rotate at least 180° once the panels are moved out of the main plane of alignment such that all panels are pivotable into the stacked configuration for stowage and/or transport.

Ideally, the pivotal coupling arrangement enables relative rotation of all of the edges of the panels once the main plane of adjoining panels and their adjoining edges are moved out of alignment such that all panels are stackable one on another for stowage and/or transport.

Preferably, the pivotal coupling arrangement enables all of the edges of the panels to rotate at least 180° once the main plane of the panels and their adjoining edges are moved out of alignment such that all panels are stackable one on another for stowage and/or transport.

Ideally, the axially adjustable first and second members of the connecting means comprise of telescopic components.

Advantageously, this allows the first and second members to be nested so as to reduce the space and weight required for the parts at adjoining edges of the panels.

Preferably, the panels forming the multi-sectional ramp deck are detachably couplable to one another.

Ideally, by detachably couplable we mean that at least one panel of the multi-sectional ramp deck can be manually detached and reattached by a simple mechanical means for a semi-permanent fitting without the requirement of complex equipment to remove and reattach the one or more sections of the modular ramp system.

Advantageously, a modular ramp system which utilises removeably couplable panels enables a user to readily customise the ramp system dependent upon the user's desired purpose. This customisation is achieved via the addition or removal of specific ramp sections. This advantage can be clearly illustrated in the inventions most preferred embodiment for use within wheeled sports such as skateboarding, BMX etc. An experienced user in this embodiment may require a longer ramp to provide them with a longer period of time in the air during jumps and/or tricks. Conversely, a less experienced user may require a shorter ramp for practice and/or training. This type of simple but effective customisation is not possible within the prior art.

Preferably, the multi-sectional ramp deck of the modular ramp system is rectilinearly or curvilinearly inclined in the direction of travel of the user.

Ideally, the multi-sectional ramp deck of the modular ramp system comprises concave curvature.

Preferably, the multi-sectional ramp deck of the modular ramp system comprises unidirectional concave curvature in the direction of travel of the user.

Ideally, at least one of the load bearing means is adapted to be removably mountable on a panel of the modular ramp system.

Preferably, at least one of the load bearing means is detachably couplable.

Ideally, at least one load bearing means is detachably couplable by utilising a simple push on and pull off mechanical coupling arrangement.

Advantageously, a user can use this mechanical coupling arrangement on-site to construct the portable ramp system with a quick and simple method without the need of complex mechanical fittings.

Preferably, the load bearing means is collapsibly coupled to at least one of the panels, the load bearing means being pivotally operable between a first position, wherein the load bearing means extends parallel to the panel when the panel is in the ramp systems stackable configuration, and a second position, wherein the load bearing means projects outwardly from the panel when the panels are in their in use position.

Ideally, at least one of the load bearing means comprises a plurality of hingedly couplable load bearing members defining a tubular support member, the hinge means allowing at least two load bearing members to collapse into the tubular support member when the tubular support member is moved between an in use open tubular support member and a collapsed flat pack configuration for stowage and/or transport.

Advantageously, a modular ramp system with a load bearing means comprising of a plurality of hingedly couplable load bearing panels provides the modular ramp with a tubular support member that forms a box like configuration which is capable of greater shock absorption. This is achieved by spreading the weight of the ramp and that of the user across a greater cross-sectional support area to prevent buckling of the support member and so providing a greater stability of the ramp system upon the transverse impact with the weight of the user and sports equipment when in use.

Further advantageously, the hinge means of the loading bearing means enables an operator to collapse the load bearing means for storage with a quick and simple mechanical means without the need to use complex mechanical fixtures.

Ideally, the tubular support member is a collapsible polygonal tube having a leading edge member and a trailing edge member transverse the ramp and lateral members extending in a direction along the later edges of the ramp between the leading and trailing members, the lateral edge members being collapsible into the tube to allow the trailing edge and the leading edge members to move toward each other sandwiching the lateral members there between as the tube is collapsible for storage in an out of use position Preferably, the leading edge and trailing edge members are hinged to the lateral members along the edges of the members perpendicular to the edges contacting the ramp in the in use load bearing configuration.

Ideally, the collapsible polygonal tube is quadrangular in the in use load bearing configuration.

Preferably, the lateral members are centrally hinged to allow the lateral members to collapse between the leading edge and trailing edge members.

Ideally, the central hinge is parallel to the hinge between the edges of the lateral members and the leading and trailing edge members.

Preferably, a locking means is provided between the load bearing means and the panel to retain the load bearing means in the in use configuration.

Advantageously, this prevents the load bearing means from indivertibly collapsing away from the in use expanded configuration during use or set up.

Ideally, the locking mechanism is provided between the trailing edge member and the panel above it.

Preferably, the panels of the multi-sectional ramp deck provide the load bearing means with a correspondingly located auxiliary structural support means to prevent laterally outward buckling of the load bearing means.

Ideally, the load bearing means auxiliary structural support means is provided by an abutment means locatable on the multi-sectional ramp deck panels.

Preferably, the abutment means comprises of a protrusion means, extending orthogonally from the underside of one or more of the multi-sectional ramp deck panels slightly overlapping the potential path of movement of the one or more of the lateral members.

Advantageously, the use of a locking means and/or an auxiliary structural support means provides the modular ramp system with further structural strength upon impact with a user to prevent buckling when in use.

Preferably, at least one of the load bearing means comprises of a generally polygonal cross-section along all or a substantial part of the length of the load bearing means.

Ideally, at least one of the load bearing means comprises of a generally circular cross-section along all or a substantial part of the length of the load bearing means.

Preferably, at least one of the load bearing means comprises of a generally hexagonal cross-section along all or a substantial part of the length of the load bearing means.

Most preferably, at least one of the load bearing means comprises of a generally rectangular cross-section along all or a substantial part of the length of the load bearing means.

Ideally, a panel engagement means is provided between at least one of the load bearing means and a panel enabling the load bearing means to be detachably engagable with a panel.

Preferably, the panel engagement means comprises of male and female components.

Ideally, the panel engagement means comprises of a latch mechanism.

Preferably, the panel engagement means comprises a hook or claw and complementary aperture or slot arrangement.

Most preferably, the panel engagement means comprises a magnetic coupling arrangement.

Advantageously, the utilisation of a panel engagement means which enables the load bearing means to be detachably engageable with a panel enables a user to securely attach the load bearing means to a corresponding panel for transport. This effectively reduces the amount of parts that an individual is required to carry whilst allowing an operator to attach different sizes of load bearing means for different standards of user or different levels of competition. As a result this enables a greater adaptability and portability of the ramp structure to that of the prior art, especially as an individual would be able to comfortably carry the ramp system on their back to and from their place of use.

Further advantageously, this secure attachment of the load bearing means reduces the risk of injury and muscle strain to the user and other potential third parties during the ramp systems transformation stages by empowering a user with the control at his/her own pace how quickly the ramp system opens and/or retracts at each stage.

Preferably, the modular ramp system load bearing means are provided with a stabilisation means locatable proximal to the ground on which the modular ramp system is placed in use.

Advantageously, a stabilisation means provides the modular ramp system with a further customisation aspect so that the ramp system is universal depending on the desired use of the ramp. Furthermore these stabilisation means provide the modular ramp system with further stability when in use, as the ramp will be generally unable to move upon impact by the user and their various sports equipment.

Ideally, the stabilisation means of the modular ramp system provides the load bearing means with studs and/or spikes for use on grasslands or the like.

Preferably, the stabilisation means of the modular ramp system provides the load bearing means with a rubberised sole for use on concrete or other rigid surfaces.

Ideally, the stabilisation means of the modular ramp system provides the load bearing means with flexible pegs to attach to iced and/or snow covered surfaces or the like.

It will be appreciated that there are other forms of stabilisation methods dependant on the surface and that the noted adaptations are by way of example of the various applications only and by no means limit the invention.

Preferably, the panels of the multi-sectional ramp deck comprise a panel framing means and a panel surface arrangement.

Ideally, the panel surface arrangement is fastenable to the panel framing means.

Preferably, the panel surface arrangement is fastenable to the panel framing means by the use of an adhesive.

Ideally, the panel surface arrangement is fastenable to the panel framing means by the use of screws or the like.

Preferably, the panel framing means provides a surface area for carrying printed designs, logos or advertising media.

Ideally, the panel surface arrangement comprises of a smooth surface.

Alternatively, the panel surface arrangement comprises of the gripping means.

Preferably, the gripping means of the panel surface arrangement is provided by a plurality of dimpled structures.

Ideally, the gripping means of the panel surface arrangement is provided by a pre manufactured method of sandblasting or the like.

Preferably, the panel framing means of the multi-sectional ramp deck is formed of metal alloy.

Ideally, the panel framing means of the multi-sectional ramp deck is formed of steel.

Preferably, the panel framing means of the multi-sectional ramp deck is formed of titanium.

Ideally, the panel framing means of the multi-sectional ramp deck is formed of a carbon fibre composite.

Most ideally, the panel framing means of the multi-sectional ramp deck is formed of aluminium.

Preferably, the panel surface arrangement of the multi-sectional ramp deck is formed of a composite material.

Most preferably, the panel surface arrangement of the multi-sectional ramp deck is formed of polycarbonate.

Ideally, at least part of the panel surface arrangement is transparent.

Preferably, the load bearing members of the collapsible load bearing means are formed of a composite material.

Most preferably, the load bearing members of the collapsible load bearing means are formed of polycarbonate.

In a further embodiment, the modular ramp system comprises a camera attachment means.

Ideally, the camera attachment means is detachably coupleable to at least one of the panels of the multi-sectional ramp deck.

Preferably, the orientation of the camera attachment means is adjustable relative to the ramp system.

Advantageously, a ramp system that maintains a camera attachment means enables a user to record and subsequently showcase on social-networking or the like their tricks and jumps, if the user desires. Furthermore, a detachably couplable camera attachment would not limit a user to use with a specific multi-sectional ramp deck panel. This adds a further personalisation method for the sporting experience by enabling the user to dictate the angle of the image to be taken by choosing the cameras location and angular orientation upon the ramp structure.

In a further embodiment the modular ramp system comprises of a lighting means.

Ideally, the lighting means is locatable proximal to at least one side of at least one of the panels of the multi-sectional ramp deck.

Preferably, the lighting means is locatable proximal to at least one side of at least one of the panels of the multi-sectional ramp deck and in the space between the framing means of multi-sectional ramp and its associated surface arrangement protection.

Ideally, the modular ramp system lighting means comprises of a plurality of light emitting devices such as LED's.

Advantageously, the utilisation of the conventional prior art ramps for sports such as skateboarding BMX etc relied on the user to train and/or perform in either daylight conditions or in a strictly defined and substantially lit area such as a skate park or arena etc. On the other hand a ramp system that maintains a light source enables a user to utilise the ramp in areas and/or at times of lower lighting. This further adds to the portability and usability of the ramp and could not be achieved within the prior art.

Preferably, the weight of the modular ramp system including a panel of the multi-sectional ramp deck and an associated load bearing means is greater than 3 kg.

Ideally, the weight of the modular ramp system including a panel of the multi-sectional ramp deck and an associated load bearing means is greater than 4 kg.

Preferably, the weight of the modular ramp system including a panel of the multi-sectional ramp deck and an associated load bearing means is less than 9 kg.

Ideally, the weight of the modular ramp system including a panel of the multi-sectional ramp deck and an associated load bearing means is less than 8 kg.

Most Ideally, the weight of the modular ramp system including a panel of the multi-sectional ramp deck and an associated load bearing means is 6 kg.

A further embodiment of the invention may be designed as a temporary structure for a mobility aid such as a wheelchair user were conventional permanently fixed mobility ramps are unavailable for entry to a building structure or vehicle. This would be useful where a wheelchair user is entering a property of another person with high steps for example or for entering a vehicle not properly adapted for wheelchair access. Normally, the wheelchair user would be manually hoisted up and over any possible obstacles such as steps to gain entry into the property or vehicle. This ultimately could cause muscle strain and/or injury to the hoisting individual(s) if the lift is not performed and/or managed correctly. Alternatively similar to skateboarders or the like a homemade ramp may be required to be produced.

Accordingly, the present invention provide a hinge arrangement comprising a pivotal coupling arrangement having a first member being couplable to a first component and being pivotally coupled to a second member which is couplable to a second component, the first member and the second member being axially adjustable relative to one another to allow the main plane of the adjacent components to be moved into and out of alignment so as to allow relative rotation of the components once the panels are moved out of alignment. This allows adjoining components to be stackable one on another for stowage while maintaining the connection of the component's leading edge to the corresponding adjacent components trailing edge.

Preferably, the pivotal coupling arrangement enables the components to rotate at least 180° once the components are moved out of the main plane of alignment such that all components are pivotable into the stacked configuration for stowage and/or transport.

Ideally, the pivotal coupling arrangement enables relative rotation of all of the edges of the components once the main plane of adjoining components and their adjoining edges are moved out of alignment such that all components are stackable one on another for stowage and/or transport.

Preferably, the pivotal coupling arrangement enables all of the edges of the components to rotate at least 180° once the main plane of the components and their adjoining edges are moved out of alignment such that all components are stackable one on another for stowage and/or transport.

Ideally, the axially adjustable first and second members of the hinge arrangement comprise of telescopic components.

Advantageously, this allows the first and second members to be nested so as to reduce the space and weight required for the parts at adjoining edges of the components.

Ideally, the axially adjustable first and second members of the hinge arrangement are telescopic cylindrical tubular components.

Preferably, the telescopic cylindrical tubular components have a semicircular plate connected at an upper end which forms a full circular plate in coplanar arrangement in alignment with the upper surface of the components when two adjoining components are in alignment in an in use position.

Ideally, an intermediate telescopic cylinder is mechanically coupled to both of the first and second telescopic cylindrical tubular components.

Preferably, the intermediate telescopic cylinder being located telescopically inside the first telescopic cylindrical tubular components and being located telescopically outside the second telescopic cylindrical tubular component. This intermediate telescopic cylinder allows a much reduced length of second telescopic cylindrical tubular component allowing the pivotal coupling arrangement to form a compact hinge arrangement when the two adjoining components are in alignment in an in use position.

The invention will now be described with reference to the accompanying drawings which show by way of example only four embodiments of a modular ramp system in accordance with the invention. In the drawings.

Figure 14:
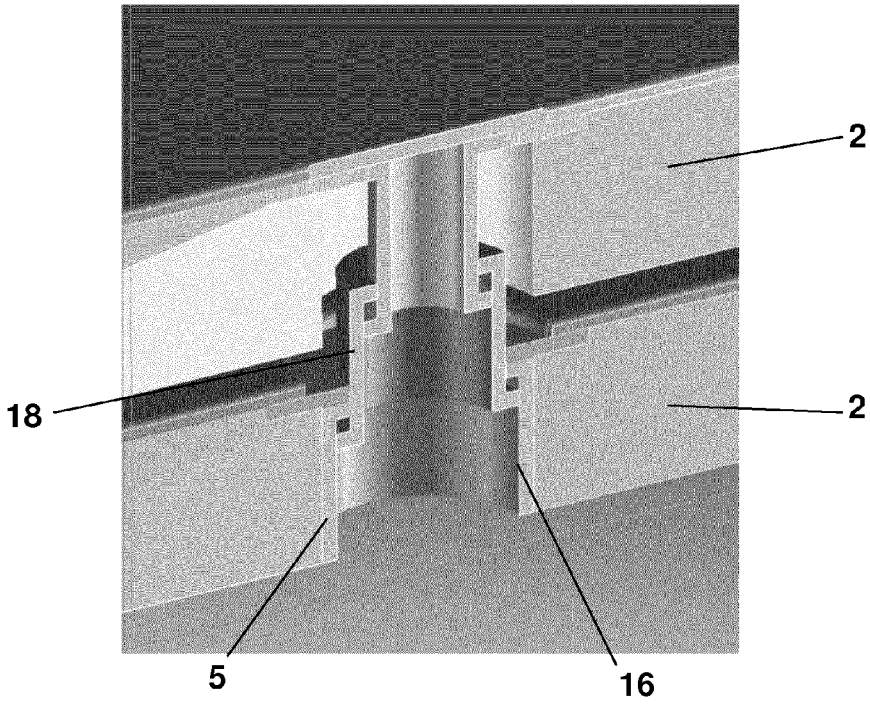
FIG. 14 is a second cross sectional perspective view of a pivotal coupling arrangement of the present invention located in situ in a panel of the modular ramp system in a second position.

In the drawing, and referring initially to FIGS. 1 to 5, there is shown a modular ramp system indicated generally by the reference numeral 1 having three panels 2 assembled to form a multi-sectional ramp deck 3. A collapsible load bearing arrangement 4 is provided for supporting each panel 2 of the multi-sectional ramp deck 3 at an inclined angle and a predetermined distance above the ground. The three panels 2 having a correspondingly located connecting well 6 for receiving a connecting member 5 see FIGS. 11 to 14 located proximal to a leading edge 7 and a trailing edge 8 of the adjoining edges 7, 8 of two adjacent panels 2. The connecting member 5 having the functionality for enabling the main plane of the panels 2 to enter into, see especially FIGS. 1 to 6, 13, 16 and 17 and out of alignment see especially FIGS. 14 and 15 with one another to engage and disengage the multi-sectional ramp deck 3. The connecting members 5 also having means for enabling relative movement of the panels 2 when the main plane of the panels is out of alignment see especially FIGS. 14 and 15 such that all panels 2 are stackable one on another for stowage and/or transport see especially FIG. 15.

Figure 15:
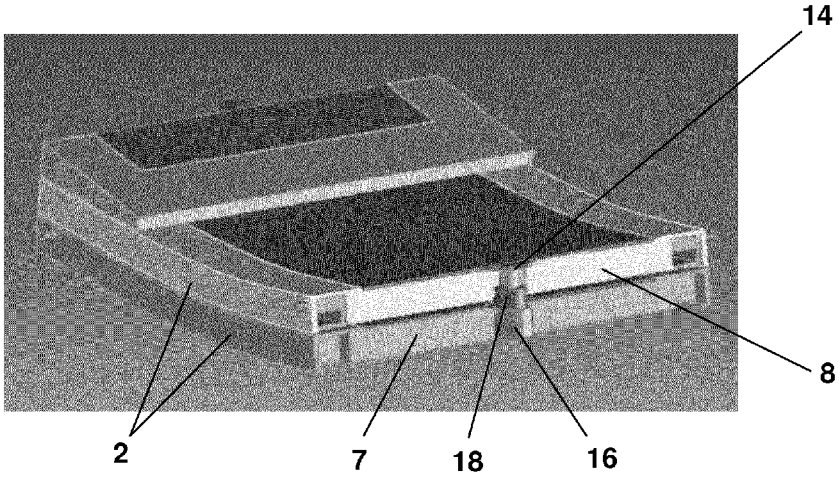
FIG. 15 is a perspective view of the modular ramp system in a folded/stacked configuration for storage and/or transport.

Advantageously, the adjustable connecting members 5 allows a ramp system 1 to be rigidly connected in an in use position see especially FIGS. 1 to 6, 13, 16 and 17 but also allows a single person to easily move the separate panels 2 of the ramp system 1 into a stackable configuration FIG. 15 so that the ramp system 1 occupies a much shorter overall lengthwise space allowing a single person to transport the ramp system 1 on their back for example. This allows one person to take the ramp system 1 on their back while cycling to the area where they want to utilise the ramp system 1.

Further advantageously, in urban environments this invention is advantageous to allow users to create a ramp system 1 comprising modular components that are combinable together and may be easily assembled for use and disassembled for storage. An example of this is whereby a user has a driveway at their home where the ramp system 1 may be assembled, but the user must be able to disassemble and store those components when the driveway is to be used for normal vehicle use. In a further example a user may wish to disassemble the ramp system 1 to transport to an area where space would not be a limiting factor such as a general recreational park etc and reassemble the ramp system 1 upon arrival at the chosen location.

The connecting members 5 are mechanically coupled to the panels 2 at the wells 6 by suitable mechanical fastening means well known in the art. This maintains the connection between the two adjacent panels 2 of the multi-sectional ramp deck 3 at all times during the modular ramp system 1 expanded configuration and retracted stowage configuration. The connecting members 5 enables the main plane of the panels 2 to enter into and out of alignment with one another so that the leading edge 7 and trailing edge 8 of the adjoining edges 7, 8 of two adjacent panels 2 are moved into and out of contact with each other. This provides engagement and disengagement of the multi-sectional ramp deck 3 and enables relative movement of the panels 2 such that the panels 2 are stackable without the requirement to remove the connecting members 5. The connecting members 5 enable relative movement of all of the edges of the panels 2 once the main plane of adjoining panels 2 are moved out of alignment such that all panels 2 are stackable one on another for stowage and/or transport see especially FIG. 15.

In one embodiment of the invention not shown in the drawings, the connecting members are provided by a sliding mechanism operable between adjacent panels. The sliding mechanism enables relative translational movement of adjacent panels. The sliding mechanism is integral to the individual panels. In an alternative arrangement, the sliding mechanism is mechanically coupled to the panels. The sliding mechanism comprises protrusions locateable on the sides of a panel and a correspondingly located elongate receiving channel locateable on the side of the adjacent panel. The elongate receiving channels guide the movement of the protrusions such that all panels are stackable one on another in a nested configuration for stowage and/or transport.

In the embodiment shown in the drawings in FIGS. 11 to 15, the connecting members 5 are provided by a specially designed hinge connections 5. The connecting members 5 are a pivotal coupling arrangement 5 comprising a first member 14 being coupled to a first panel 2 via fasteners inserted through apertures 15 and being pivotally coupled to a second member 16 which is coupled to a second panel 2. The first member 14 and the second member 16 are axially adjustable relative to one another via an intermediate telescopic cylinder 18 to allow the main plane of the adjacent panels 2 to be moved into and out of alignment so as to allow subsequent relative rotation of the panels 2 once the panels 2 are moved out of alignment. This allows all panels 2 to be stackable one on another for stowage and/or transport while maintaining the connection of the panels leading edge 7 to the corresponding adjacent panels trailing edge 8.

The pivotal coupling arrangement 5 enables the panels 2 to rotate at least 180° once the panels 2 are moved out of the main plane of alignment such that all panels 2 are pivotable into the stacked configuration for stowage and/or transport as illustrated in FIG. 15. The pivotal coupling arrangement 5 enables relative rotation of all of the edges of the panels 2 once the main plane of adjoining panels 2 and their adjoining edges are moved out of alignment such that all panels 2 are stackable one on another for stowage and/or transport. The pivotal coupling arrangement 5 enables all of the edges of the panels 2 to rotate at least 180° once the main plane of the panels 2 and their adjoining edges are moved out of alignment such that all panels 2 are stackable one on another for stowage and/or transport see especially FIG. 15. The axially adjustable first and second members 14, 16 of the connecting members 5 are telescopic cylindrical tubular components with a semicircular plate 21, 22 connected at an upper end which forms a full circular plate in coplanar arrangement in alignment with the upper surface of the ramp system 1 when two adjoining panels 2 are in alignment in the in use position see FIG. 11. An intermediate telescopic cylinder 18 is mechanically coupled to both of the telescopic cylindrical tubular components 14 and 16, being located telescopically inside the telescopic cylindrical tubular components 16 and being located telescopically outside the telescopic cylindrical tubular component 14. This intermediate telescopic cylinder 18 allows a much reduced length of telescopic cylindrical tubular component 14 allowing the pivotal coupling arrangement 5 to form a compact hinge when the two adjoining panels 2 are in alignment in an in use position.

Advantageously, this allows the first and second members 14 and 16 to be nested so as to reduce the space and weight required for the parts at adjoining edges of the panels 2.

The panels 2 forming the multi-sectional ramp deck 3 are detachably couplable to one another. By detachably couplable we mean that at least one panel 2 of the multi-sectional ramp deck 3 can be manually detached and reattached by a simple mechanical means for a semi-permanent fitting without the requirement of complex equipment to remove and reattach the one or more sections 2 of the modular ramp system 1. Quick attach and release mechanical coupling fixtures can be used in place of fasteners to connect the panels 2 to the pivotal coupling arrangement 5. Advantageously, a modular ramp system 1 which utilises removeably couplable panels 2 enables a user to readily customise the ramp system 1 dependent upon the user's desired purpose. This customisation is achieved via the addition or removal of specific ramp sections. This advantage can be clearly illustrated in the inventions most preferred embodiment for use within wheeled sports such as skateboarding, BMX etc. An experienced user in this embodiment may require a longer ramp 1 to provide them with a longer period of time in the air during jumps and/or tricks. Conversely, a less experienced user may require a shorter ramp 1 for practice and/or training.

The multi-sectional ramp deck 3 of the modular ramp system 1 is curvi-linearly inclined in the direction of travel of the user. The multi-sectional ramp deck 3 of the modular ramp system 1 illustrated in the drawings has a concave curvature. The multi-sectional ramp deck 3 of the modular ramp system comprises unidirectional concave curvature in the direction of travel of the user.

The load bearing arrangement 4 is adapted to be removably mountable on a panel 2 of the modular ramp system 1. One embodiment of load bearing arrangement 4 not shown in the drawings is detachably coupled by utilising a simple push on and pull off mechanical coupling arrangement. Advantageously, a user can use this mechanical coupling arrangement on-site to construct the portable ramp system 1 with a quick and simple method without the need of complex mechanical fittings.

The load bearing arrangement 4 illustrated in FIGS. 1 to 6 and 16 and 17 is collapsibly coupled to each of the panels 2. The load bearing arrangement 4 is pivotally operable between a first position, wherein the load bearing arrangement 4 extends parallel to the underside of the panel 2 when the panel 2 is to be moved into and is in the ramp systems stackable configuration, and a second position as illustrated in the drawings, wherein the load bearing arrangement 4 projects outwardly from the underside of the panel 2 when the panels 2 are in their in use position.

The load bearing arrangement illustrated in FIGS. 1 to 6 have a plurality of hingedly couplable load bearing members 31 defining a tubular support member 4. The hinges 33 allowing at least two load bearing members 31 to collapse into the tubular support member 4 when the tubular support member 4 is moved between an in use open tubular support member 4 and a collapsed flat pack configuration for stowage and/or transport not shown.

Advantageously, a modular ramp system 1 with a load bearing arrangement 4 having a plurality of hingedly couplable load bearing members 31 provides the modular ramp system 1 with a tubular support member 4 that forms a box like configuration which is capable of greater shock absorption. This is achieved by spreading the weight of the ramp system 1 and that of the user across a greater cross-sectional support area to prevent buckling of the support member 4 and so providing a greater stability of the ramp system 1 upon the transverse impact with the weight of the user and sports equipment when in use.

Further advantageously, the hinges 33 of the loading bearing arrangement 4 enables an operator to collapse the load bearing arrangement 4 for storage with a quick and simple mechanical arrangement without the need to use complex mechanical fixtures.

Figure 1:
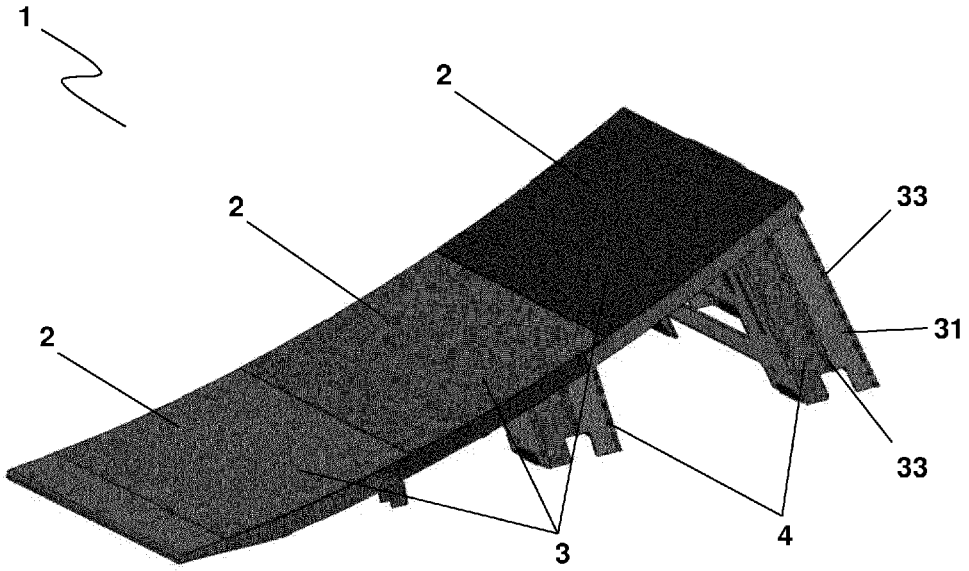
FIG. 1 is a perspective view of a first embodiment of a modular ramp system.
Figure 2:
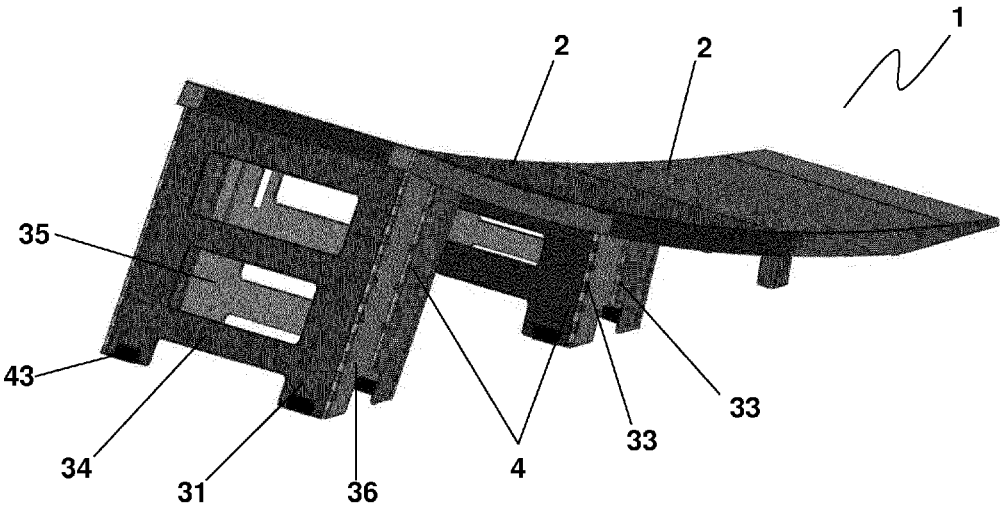
FIG. 2 is a second perspective view of the first embodiment of a modular ramp system.
Figure 3:
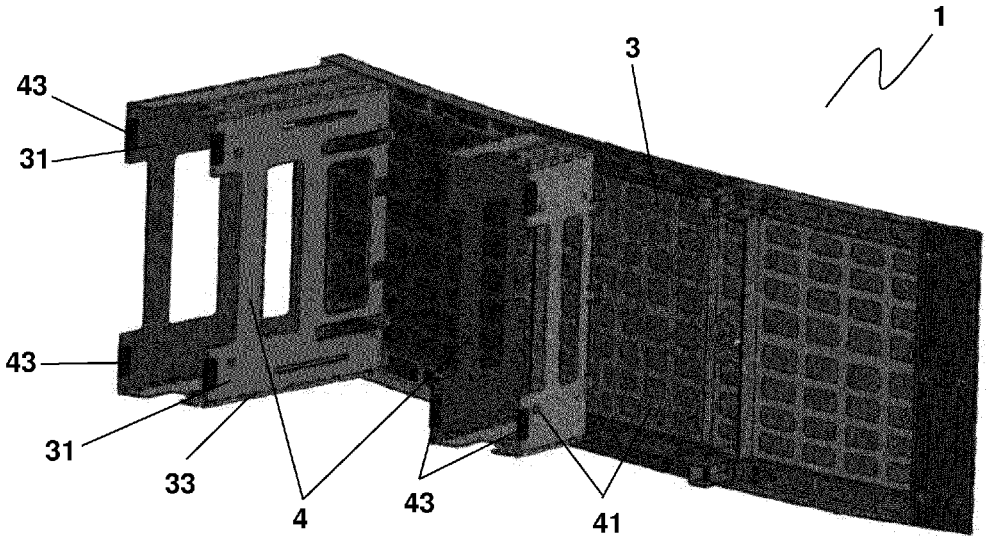
FIG. 3 is an underside perspective view of the first embodiment of a modular ramp system.

The tubular support member 4 is a collapsible polygonal tube 4 having a leading edge member 34 and a trailing edge member 35 tranverse the ramp and lateral members 36 see FIG. 2 extending in a direction along the later edges of the ramp 1 between the leading and trailing edge members 34, 35. At least one of the leading edge and trailing edge members 34, 35 is movable towards the other member 34, 35 via a guide arrangement acting between at least one of the members and the underside or side of the panel 2. The lateral edge members 36 are collapsible into the tube 4 to allow the trailing edge and the leading edge members 34, 35 to move toward each other sandwiching the lateral edge members 36 there between as the tube is collapsible for storage in an out of use position. The leading edge and trailing edge members 34 and 35 are hinged to the lateral members 36 along the edges of the members 34, 35, 36 perpendicular to the edges contacting the ramp 1 in the in use load bearing configuration.

The collapsible polygonal tube 4 is quadrangular in the in use load bearing configuration. The lateral edge members 36 are centrally hinged to allow the lateral members to collapse between the leading edge and trailing edge members 34 and 35. The central hinge is parallel to the hinge between the edges of the lateral members 36 and the leading and trailing edge members 34, 35. A locking arrangement is provided between the load bearing arrangement 4 and the panel 2 to retain the load bearing arrangement 4 in the in use configuration. Advantageously, this prevents the load bearing arrangement 4 from inadvertently collapsing away from the in use expanded configuration during use or set up. The locking mechanism is provided between the trailing edge member 35 and the panel 2 above it. The panels 2 of the multi-sectional ramp deck 3 provide the load bearing arrangement with a correspondingly located auxiliary structural support means to prevent laterally outward buckling of the load bearing arrangement 4. The load bearing arrangement auxiliary structural support is provided by an abutment located on the multi-sectional ramp deck panels 2. The abutment comprises a protrusion, extending orthogonally from the underside of one or more of the multi-sectional ramp deck panels 2 slightly overlapping the potential path of outward movement of the one or more of the lateral edge members 36.

Advantageously, the use of a locking arrangement and/or an auxiliary structural support provides the modular ramp system 1 with further structural strength upon impact with a user to prevent buckling when in use. A panel engagement arrangement 41 is provided between the load bearing arrangement 4 and a panel 2 enabling the load bearing arrangement 4 to be detachably engagable with a panel 2. The panel engagement arrangement is a male and female component 41. Alternatively, the panel engagement could comprise of a latch mechanism, a hook or claw and complementary aperture or slot arrangement and/or a magnetic coupling arrangement. Advantageously, the utilisation of a panel engagement arrangement 41 enables the load bearing arrangement 4 to be detachably engageable with a panel 2 enabling a user to securely attach the load bearing arrangement 4 to a corresponding panel 2 for transport.

The load bearing arrangement 4 being detachably couplable to the panel 2 in these ways effectively reduces the amount of parts that an individual is required to carry whilst allowing an operator to attach different sizes of load bearing arrangements for different standards of user or different levels of competition. As a result this enables a greater adaptability and portability of the modular ramp system 1 to that of the prior art, especially as an individual would be able to comfortably carry the ramp system 1 on their back to and from their chosen place of use. Further advantageously, this secure attachment of the load bearing arrangement 4 reduces the risk of injury and muscle strain to the user and other potential third parties during the ramp systems transformation stages by empowering a user with the control at his/her own pace how quickly the ramp system opens and/or retracts at each stage.

The modular ramp system's 1 load bearing arrangements 4 are provided with a stabilisation device 43 located proximal to the ground on which the modular ramp system 1 is placed in use. Advantageously, a stabilisation device 43 provides the modular ramp system 1 with a further customisation aspect so that the ramp system 1 is universal depending on the desired use of the ramp system 1. Furthermore these stabilisation devices 43 provide the modular ramp system 1 with further stability when in use, as the ramp system 1 will be generally unable to move upon impact by the user and their various sports equipment. The stabilisation devices 43 of the modular ramp system 1 provides the load bearing arrangement 4 with a number of rubberised soles 43 for use on concrete or other rigid surfaces. Alternatively, studs and/or spikes can be provided for use on grasslands or the like. Alternatively, the stabilisation devices can be flexible pegs to attach to ice and/or snow covered surfaces or the like. It will be appreciated that there are other forms of stabilisation devices can be used dependant on the surface and that the noted adaptations are by way of example of the various applications only and by no means limit the invention.

The panels 2 of the multi-sectional ramp deck 3 see especially FIGS. 7 to 10, have a panel frame 45 and a panel surface arrangement 46. The panel surface arrangement 46 is fastenable to the panel frame 45. The panel surface arrangement 46 is fastenable to the panel frame by the use of an adhesive or alternatively by fasteners such as screws or the like. The panel frame 45 is designed to minimise the weight of the modular ramp system 1 with as much material as possible removed while retaining the structural strength of the panel frame 45. It also provides a surface area for carrying printed designs, logos or advertising media 47 see FIG. 9. The panel surface arrangement 46 is smooth surface. Alternatively, the panel surface arrangement 46 has a surface gripping arrangement. The panel frame 45 of the multi-sectional ramp deck 3 is formed of a metal alloy such as steel. Alternatively, the panel frame 45 of the multi-sectional ramp deck 3 is formed of titanium, aluminium, a carbon fibre composite or any combination of these materials. The panel surface arrangement 46 of the multi-sectional ramp deck 3 is formed of a composite material such as polycarbonate and at least part of the panel surface arrangement 46 is transparent. The load bearing arrangement 4 is formed of a composite material such as a polycarbonate.

Figure 4:
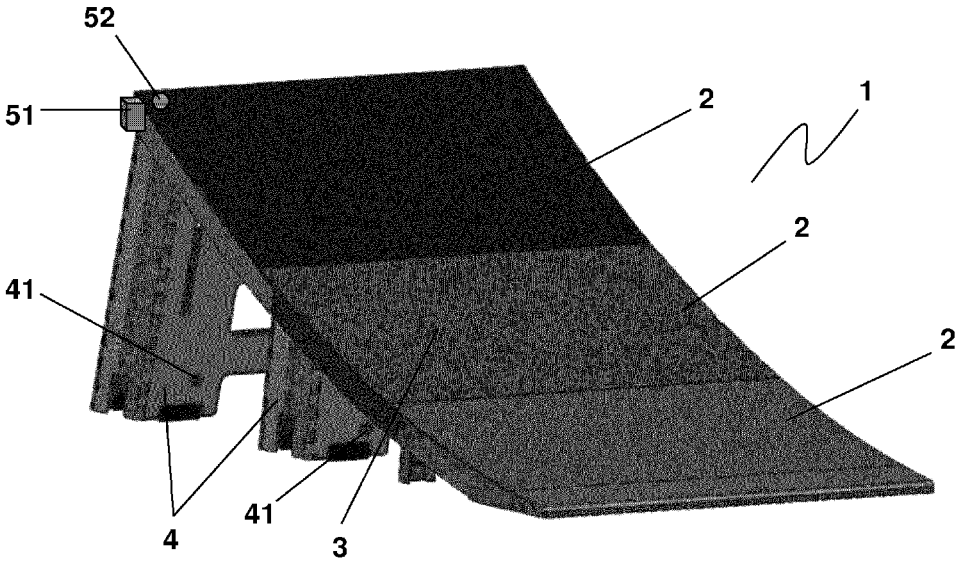
FIG. 4 is a fourth perspective view of the first embodiment of a modular ramp system.
Figure 5:
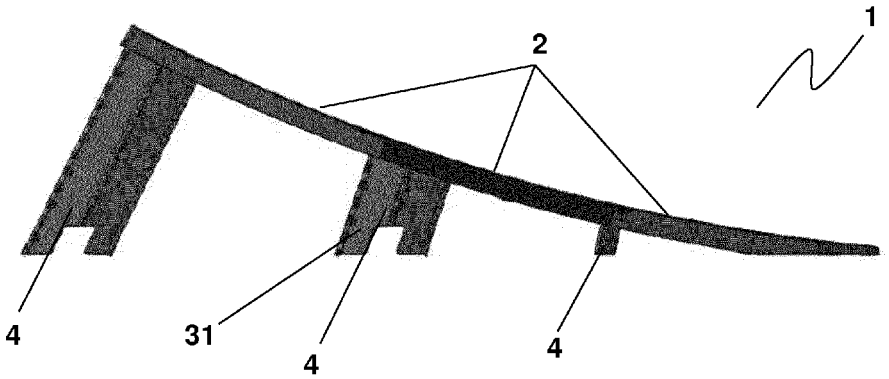
FIG. 5 is a side view of the first embodiment of a modular ramp system.
Figure 6:
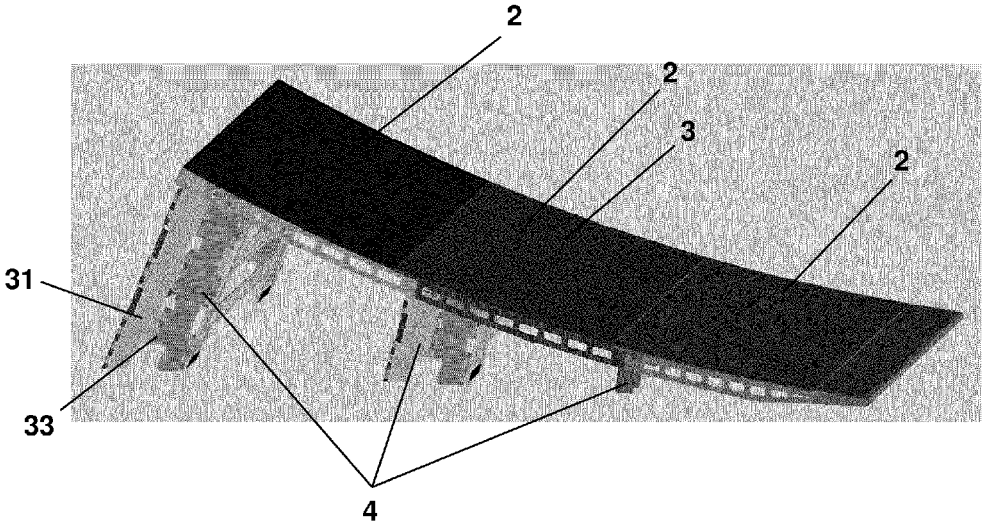
FIG. 6 is a perspective view of a second embodiment of a modular ramp system.
Figure 7:
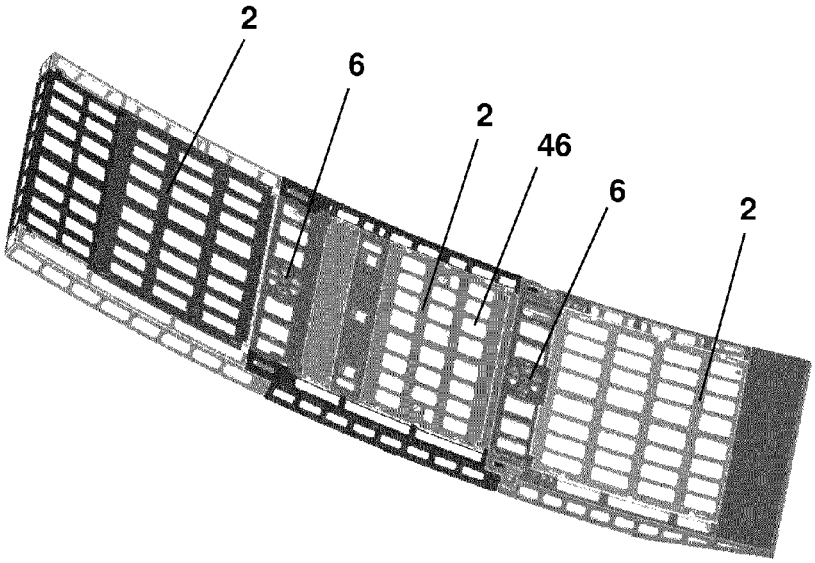
FIG. 7 is a perspective view of the multi-sectional ramp deck of a second embodiment of a modular ramp system.
Figure 8:
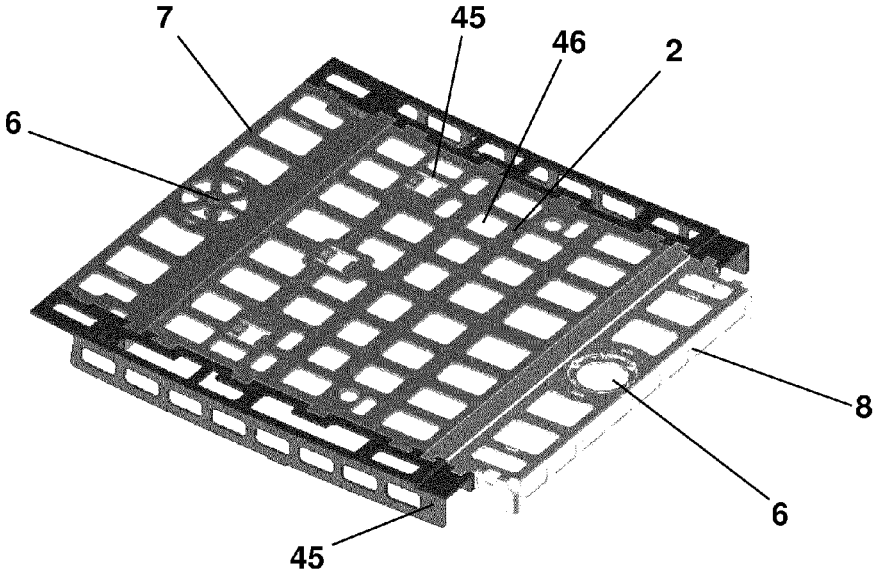
FIG. 8 is a perspective view of one intermediate panel of the multi-sectional ramp deck of a second embodiment of a modular ramp system.
Figure 9:
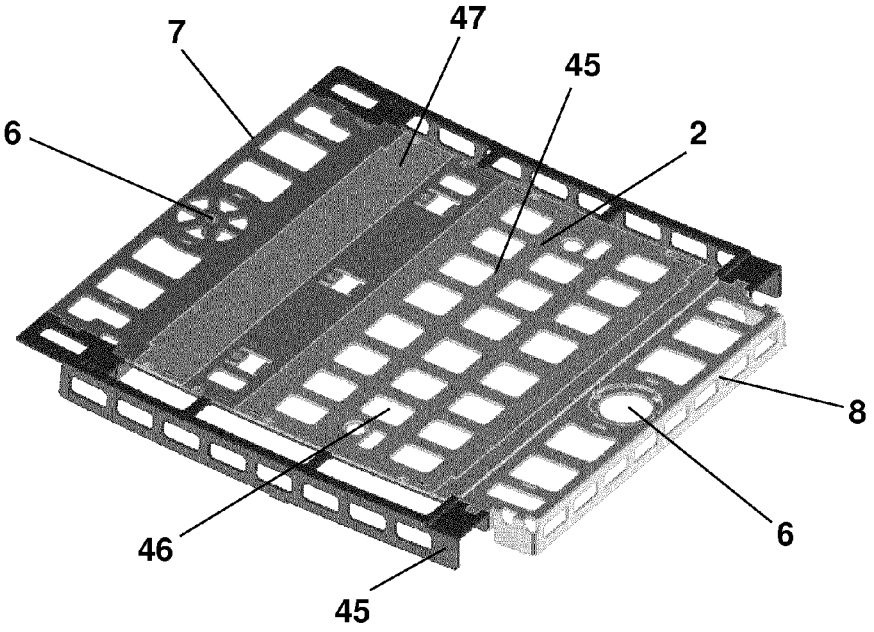
FIG. 9 is a perspective view of one intermediate panel of the multi-sectional ramp deck of a second embodiment of a modular ramp system.
Figure 10:
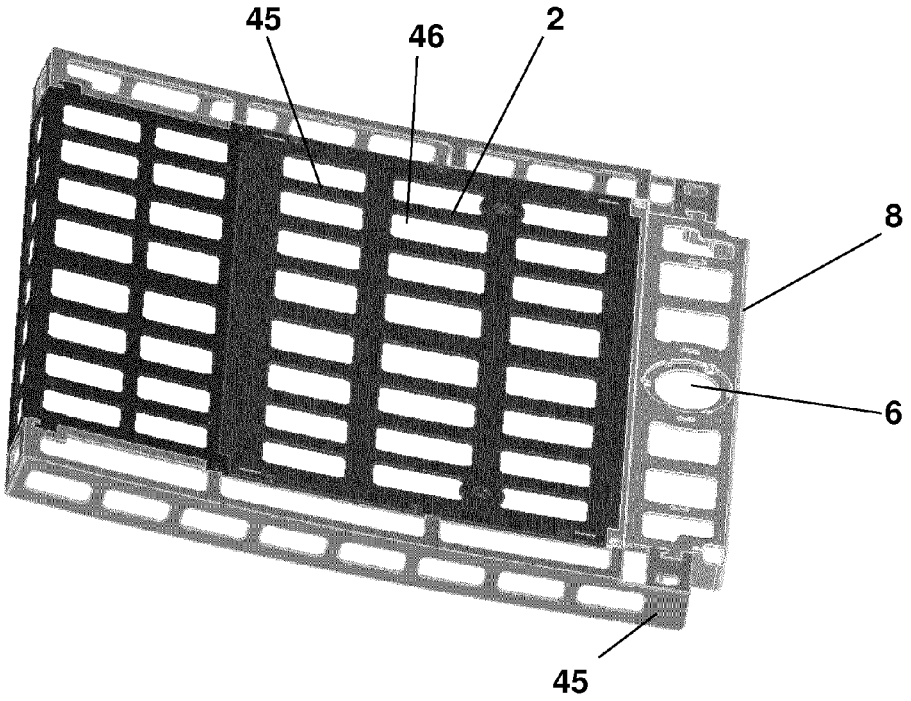
FIG. 10 is a perspective view of one take off panel of the multi-sectional ramp deck of a second embodiment of a modular ramp system.
Figure 11:
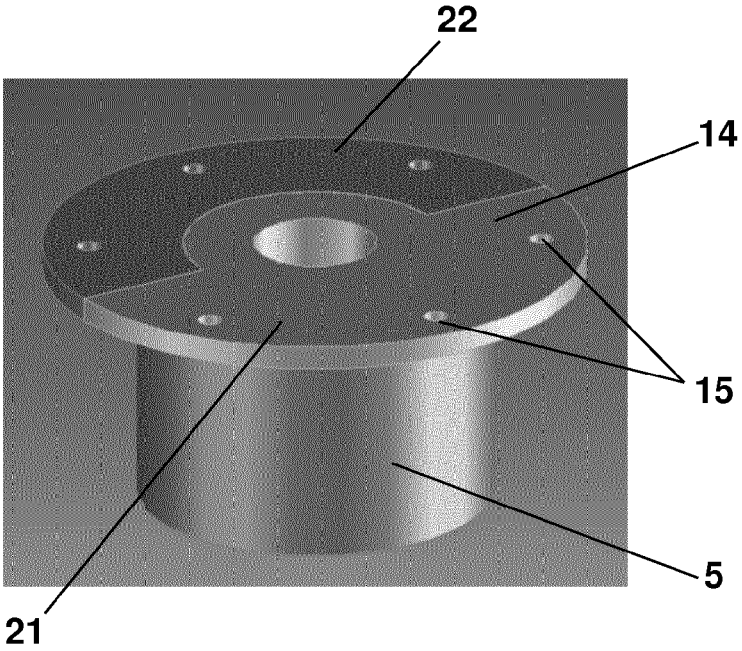
FIG. 11 is a perspective view of a pivotal coupling arrangement of the present invention.
Figure 12:
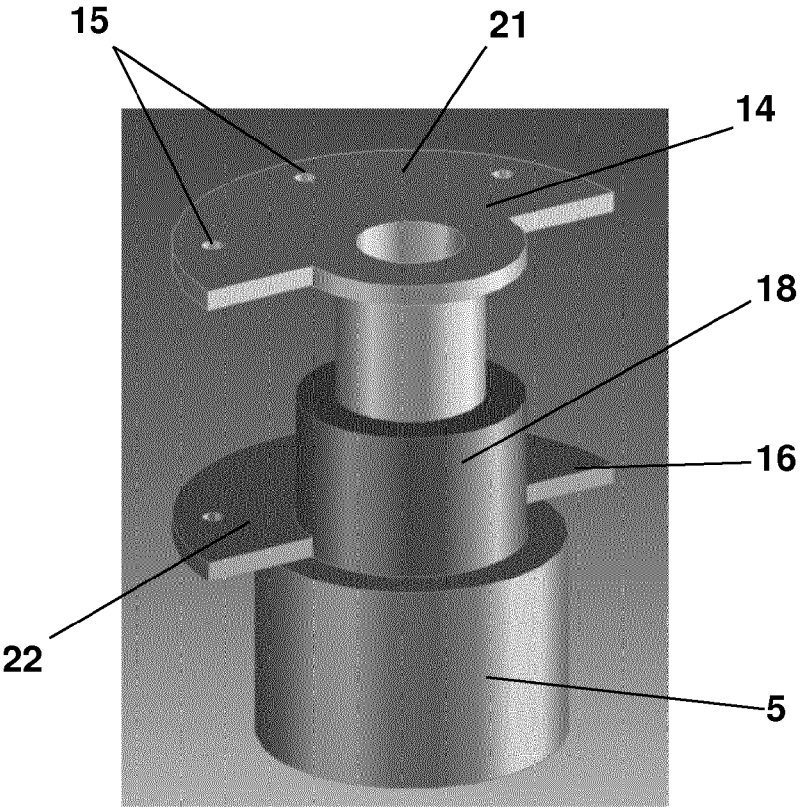
FIG. 12 is a perspective view of a pivotal coupling arrangement of the present invention in a second position.
Figure 13:
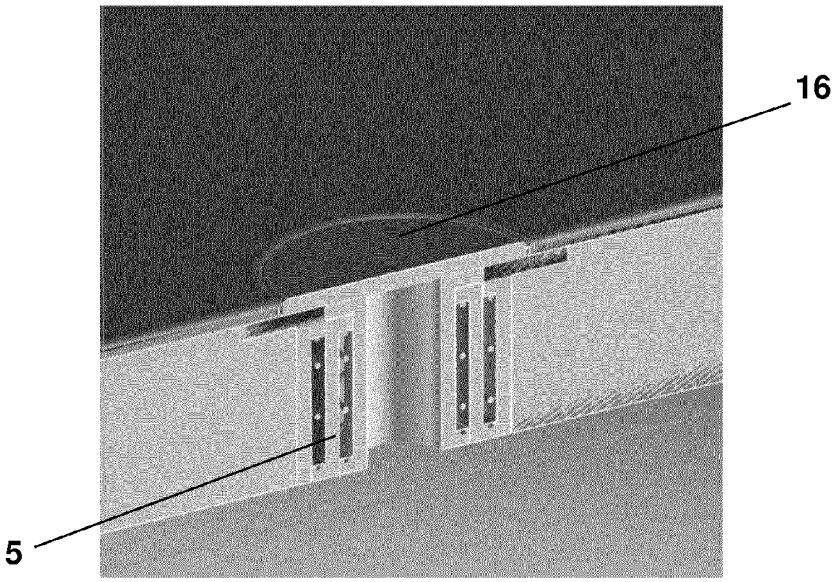
FIG. 13 is a cross sectional perspective view of a pivotal coupling arrangement of the present invention located in situ in a panel of the modular ramp system.

In a further embodiment, the modular ramp system 1 has a camera attachment arrangement 51, see FIG. 4. The camera attachment arrangement 51 is detachably coupled to one of the panels 2 of the multi-sectional ramp deck 3. The orientation of the camera attachment arrangement 51 is adjustable relative to the ramp system 1.

Advantageously, a ramp system 1 that maintains a camera attachment arrangement 51 enables a user to record and subsequently showcase on social-networking or the like their tricks and jumps, if the user desires. Furthermore, a detachably couplable camera arrangement 51 would not limit a user to use with a specific multi-sectional ramp deck panel. This adds a further personalisation method for the sporting experience by enabling the user to dictate the angle of the image to be taken by choosing the cameras location and angular orientation upon the ramp system 1. In a further embodiment, the modular ramp system has a lighting arrangement 52, see FIG. 4. The lighting arrangement 52 is locatable proximal to one side of one of the panels 2 of the multi-sectional ramp deck 3. The lighting arrangement 52 is locatable proximal to one side of one of the panels 2 of the multi-sectional ramp deck 3 and in the space between the frame 45 of multi-sectional ramp deck 3 and its associated surface arrangement protection 46. The modular ramp system 1 lighting arrangement 52 has a plurality of light emitting devices such as LED's. Advantageously, the utilisation of the conventional prior art ramps for sports such as skateboarding BMX etc relied on the user to train and/or perform in either daylight conditions or in a strictly defined and substantially lit area such as a skate park or arena etc. On the other hand a ramp system 1 that maintains a light arrangement 52 enables a user to utilise the ramp system 1 in areas and/or at times of lower lighting. This further adds to the portability and usability of the ramp system 1 and could not be achieved within the prior art. The weight of the modular ramp system 1 including a panel of the multi-sectional ramp deck and an associated load bearing means is in the range of between 3 kg and 10 kg and the most preferable weight range for the ramp is between 5 and 7 kg.

Figure 16:
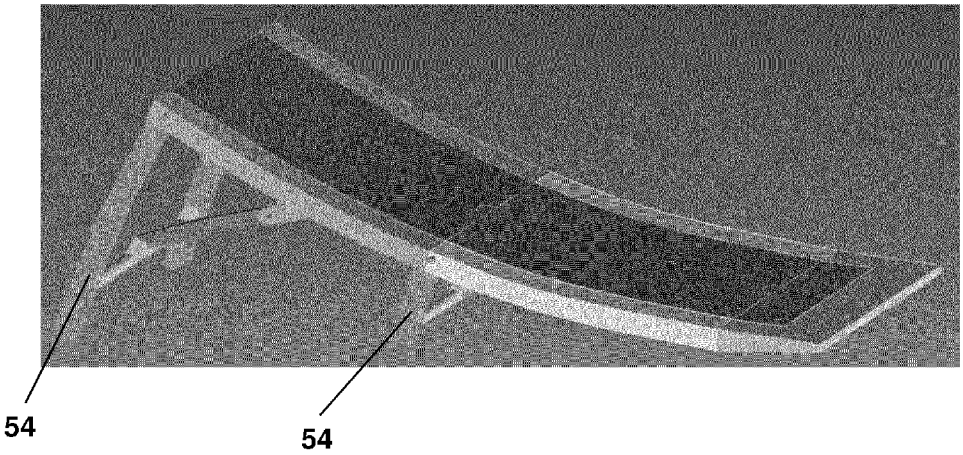
FIG. 16 is a perspective view of a third embodiment of a modular ramp system.
Figure 17:
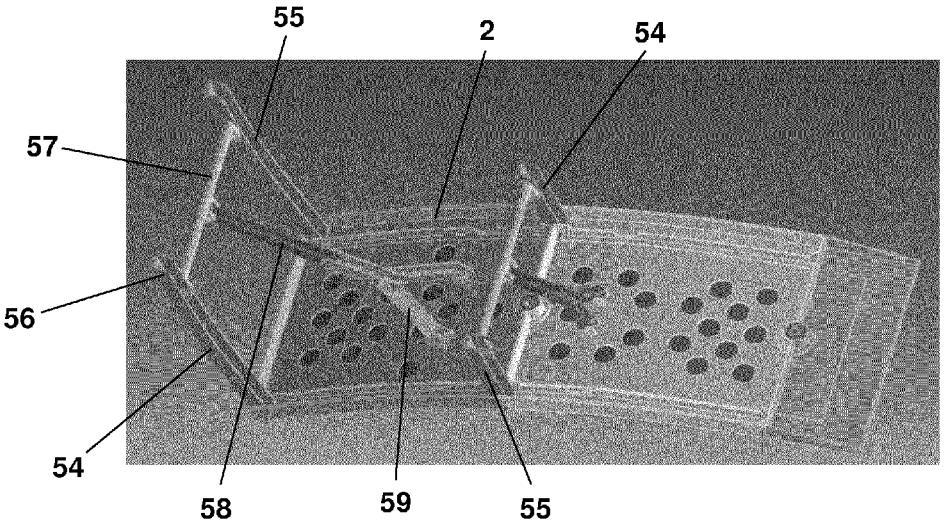
FIG. 17 is a second perspective view of the third embodiment of a modular ramp system.
Figure 18:
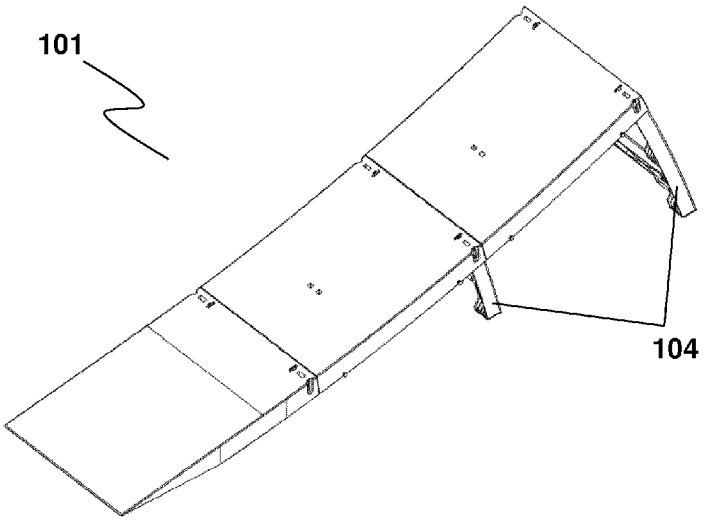
FIG. 18 is a first perspective view of a fourth embodiment of a modular ramp system.

In the third embodiment of the ramp system 1 shown in FIGS. 16 and 17, the load bearing arrangement 54 is provided by a pair of legs 55 each pivotally coupled to opposed corners of the trailing edge of a panel 2 and being connected at or about their free ends 56 by a connecting bar 57. This connecting bar 57 is coupled to the underside of the panel 2 proximal to the leading edge of the panel 2 by a leg 58 pivotally coupled at one end to the connecting bar 57 and pivotally coupled at the other end to a bifurcated coupling arm 59, the bifurcated ends of the bifurcated coupling arm 59 being pivotally coupled to the underside of the panel 2. The leg 58 and the coupling arm 59 is capable of releasably locking in the extended position to form a strut between the panel and the connecting bar 57.

A further embodiment of the invention may be designed as a temporary structure for a mobility aid such as a wheelchair user were conventional permanently fixed mobility ramps are unavailable for entry to a building structure or vehicle. This would be useful where a wheelchair user is entering a property of another person with high steps for example or for entering a vehicle not properly adapted for wheelchair access. Normally, the wheelchair user would be manually hoisted up and over any possible obstacles such as steps to gain entry into the property or vehicle. This ultimately could cause muscle strain and/or injury to the hoisting individual(s) if the lift is not performed and/or managed correctly. Alternatively similar to skateboarders or the like a homemade ramp may be required to be produced.

Referring to the drawings, and finally to FIGS. 18 to 21, there is shown a fourth embodiment of modular ramp system indicated generally by the reference numeral 101 having three panels 102 assembled to form a multi-sectional ramp deck 103. A collapsible load bearing arrangement 104 is provided for supporting each panel 102 of the multi-sectional ramp deck 103 at an inclined angle and at a predetermined distance above the ground. The three panels 102 having a correspondingly located connecting well 106 for receiving a connecting member 105 located proximal to a leading edge 107 and a trailing edge 108 of the adjoining edges 107, 108 of two adjacent panels 102. The connecting member 105 having the functionality for enabling the main plane of the panels 102 to enter into and out of alignment with one another to engage and disengage the multi-sectional ramp deck 103. The connecting members 105 also having means for enabling relative movement of the panels 102 when the main plane of the panels is out of alignment such that all panels 102 are stackable one on another for stowage and/or transport.

Figure 19:
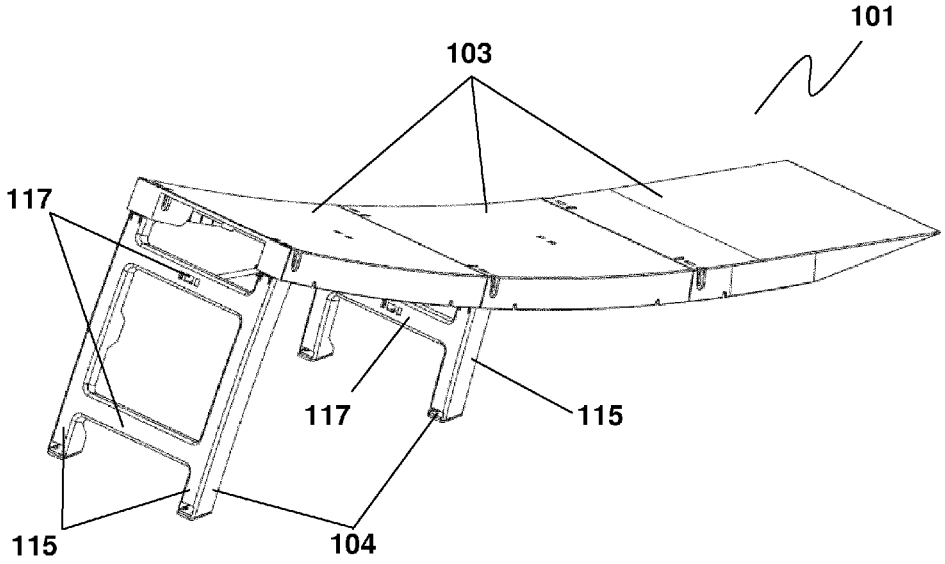
FIG. 19 is a second perspective view of the fourth embodiment of a modular ramp system.
Figure 20:
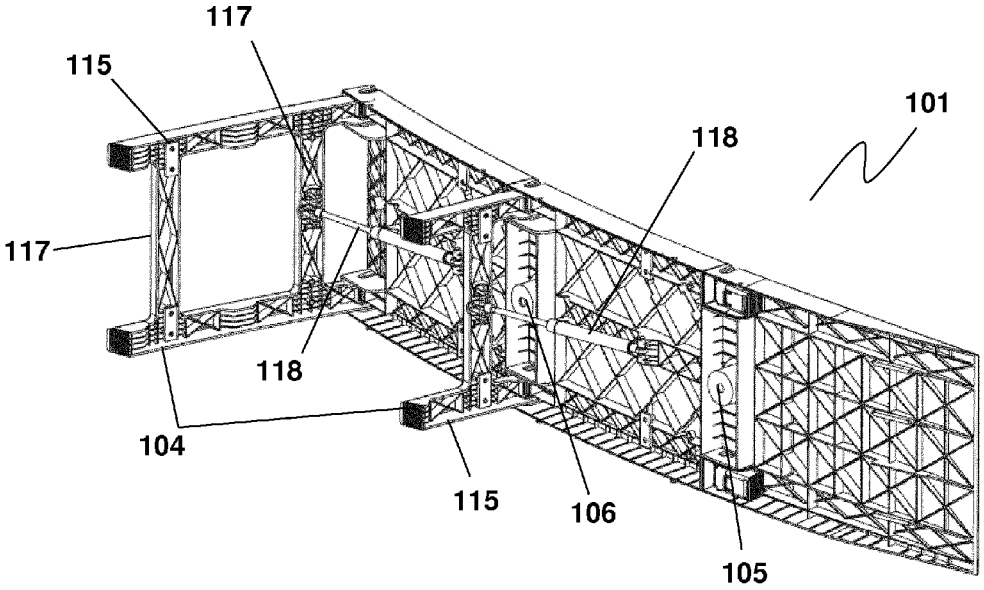
FIG. 20 is a third perspective view of a fourth embodiment of modular ramp system.
Figure 21:
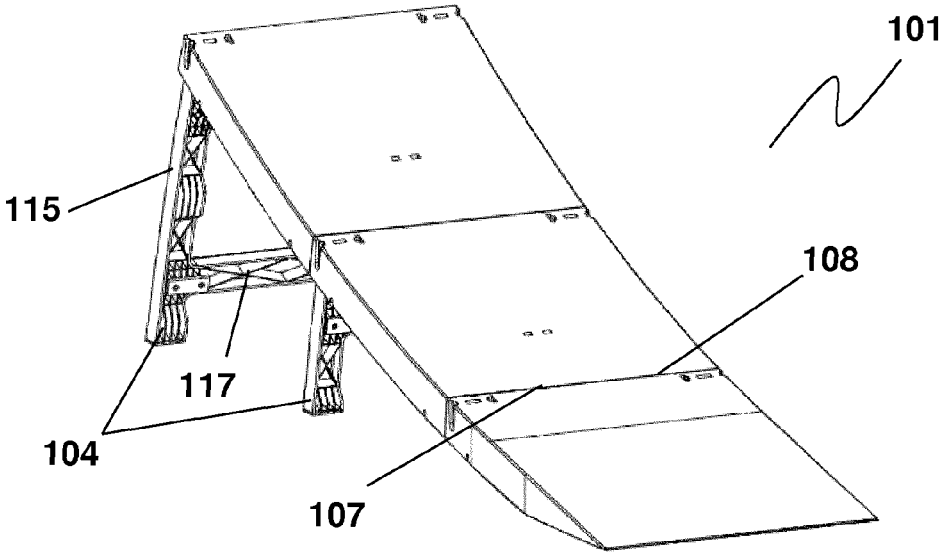
FIG. 21 is a fourth perspective view of the fourth embodiment of a modular ramp system.

In the fourth embodiment of the ramp system 101 shown in FIGS. 18 to 21, the load bearing arrangement 104 is provided by a pair of legs 115 each pivotally coupled to opposed corners of the trailing edge of a panel 102 and the pair of legs 115 being connected by one or two connecting bars 117, see especially FIGS. 19 and 21. The load bearing arrangement 104 is pivotally coupled to the underside of the panel 102 by a biasing arrangement 118. One of these connecting bars 117 is coupled to the underside of the panel 102 by a gas strut 118 pivotally coupled at one end to the connecting bar 117 and pivotally coupled at the other end of the gas strut 118 to a coupling member on the underside of the panel 102. The gas strut 118 is used to urge the load bearing arrangement 104 from the storage position into the in use position. The biasing arrangement 118 is held in the biased position by a releasable locking means operable between the panel 102 and the load bearing arrangement 104 in the storage position. When the releasable locking means is flicked opened by a user the biasing arrangement 118 acts on the load bearing arrangement 104 gently pressing the load bearing arrangement 104 out from under the panel 102 and into the upstanding in use position.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. A modular ramp system, comprising:

a plurality of panels assemblable to form a multi-sectional ramp deck;

a collapsible load bearing means for supporting each panel of the multi-sectional ramp deck at a predetermined distance off the ground; and at least two of the panels having a correspondingly located connecting means locatable proximal to a leading edge and a trailing edge of the adjoining edges of two adjacent panels;

wherein the connecting means have means for enabling the main plane of the panels to enter into and out of alignment with one another to engage and disengage the multi-sectional ramp deck;

wherein the connecting means also have means for enabling relative movement of the panels when the main plane of the panels is out of alignment such that all panels are stackable one on another for stowage or transport;

wherein the connecting means comprise a first member being coupleable to a first panel and being pivotally coupled to a second member which is coupleable to a second panel;

wherein the first member and second member are axially adjustable relative to one another for allowing the main plane of the adjacent panels to be movable into and out of alignment for allowing relative rotation of the panels once the panels are moved out of alignment;

wherein the axially adjustable first and second members of the connecting means are comprised of telescopic components.

2. The modular ramp system as claimed in claim 1, wherein the connecting means maintains the connection between the two adjacent panels of the multi-sectional ramp deck at all times during the modular ramp systems expanded configuration and retracted stowage configuration.

3. The modular ramp system as claimed in claim 1, wherein the connecting means enables the main plane of the panels to enter into and out of alignment with one another so that the leading edge and trailing edge of the adjoining edges of two adjacent panels are moved out of contact with each other.

4. The modular ramp system as claimed in claim 1, wherein the connecting means enables relative movement of all of the edges of the panels once the main plane of adjoining panels are moved out of alignment such that all panels are stackable one on another for stowage or transport.

5. The modular ramp system as claimed in claim 1, wherein the pivotal coupling arrangement enables the panels to rotate at least 180° once the panels are moved out of the main plane of alignment such that all panels are pivotable into the stacked configuration for stowage or transport.

6. The modular ramp system as claimed in claim 1, wherein the pivotal coupling arrangement enables relative rotation of all of the edges of the panels once the main plane of adjoining panels and their adjoining edges are moved out of alignment such that all panels are stackable one on another for stowage or transport.

7. The modular ramp system as claimed in claim 1, wherein the pivotal coupling arrangement enables all of the edges of the panels to rotate at least 180° once the main plane of the panels and their adjoining edges are moved out of alignment such that all panels are stackable one on another for stowage or transport.

8. The modular ramp system as claimed in claim 1, wherein the connecting means is provided by a sliding mechanism operable between adjacent panels or the connecting means comprises hinge connections.

9. The modular ramp system as claimed in claim 1, wherein the panels forming the multi-sectional ramp deck are detachably couplable to one another.

10. The modular ramp system as claimed in claim 1, wherein the multi-sectional ramp deck of the modular ramp system is rectilinearly or curvilinearly inclined in the direction of travel of the user.

11. The modular ramp system as claimed in claim 1, wherein the multi-sectional ramp deck of the modular ramp system comprises a concave curvature.

12. The modular ramp system as claimed in claim 1, wherein at least one of the load bearing means is adapted to be removably mountable on a panel of the modular ramp system.

13. The modular ramp system as claimed in claim 1, wherein the load bearing means is collapsibly coupled to at least one of the panels, the load bearing means being pivotally operable between a first position, wherein the load bearing means extends parallel to the panel when the panel is in the ramp systems stackable configuration, and a second position, wherein the load bearing means projects outwardly from the panel when the panels are in their in use position.

14. The modular ramp system as claimed in claim 1, wherein at least one of the load bearing means comprises a plurality of hingedly couplable load bearing members defining a tubular support member, the hinge means allowing at least two load bearing members to collapse into the tubular support member when the tubular support member is moved between an in use open tubular support member and a collapsed flat pack configuration for stowage or transport.

15. The modular ramp system as claimed in claim 14, wherein the tubular support member is a collapsible polygonal tube having a leading edge member and a trailing edge member transverse the ramp and lateral members extending in a direction along the lateral edges of the ramp between the leading and trailing members, the lateral edge members being collapsible into the tube to allow the trailing edge and the leading edge members to move toward each other sandwiching the lateral members there between as the tube is collapsible for storage in an out of use position.

16. The modular ramp system as claimed in claim 14, wherein the load bearing members of the collapsible load bearing means are formed of aluminum or steel or titanium or any metal alloy or a carbon fiber composite material or any combination of these materials.

17. The modular ramp system as claimed in claim 1, wherein a locking means is provided between the load bearing means and the panel to retain the load bearing means in the in use configuration or the storage configuration.

18. The modular ramp system as claimed in claim 1, wherein a panel engagement means is provided between at least one of the load bearing means and a panel enabling the load bearing means to be detachably engagable with a panel.

19. The modular ramp system as claimed in claim 1, wherein the load bearing means are provided with a stabilisation means locatable proximal to the surface on which the modular ramp system is placed in use.

20. The modular ramp system as claimed in claim 1, wherein the panels of the multi-sectional ramp deck comprise a panel framing means and a panel surface arrangement.

21. The modular ramp system as claimed in claim 20, wherein the panel surface arrangement is fastenable to the panel framing means and comprises a smooth surface or a gripping means.

22. The modular ramp system as claimed in claim 20, wherein the panel framing means of the multi-sectional ramp deck is formed of aluminum or steel or titanium or any metal alloy or a carbon fiber composite material or any combination of these materials.

23. The modular ramp system as claimed in claim 20, wherein the panel surface arrangement of the multi-sectional ramp deck is formed of a composite material including polycarbonate.

24. The modular ramp system as claimed in claim 20, wherein at least part of the panel surface arrangement is transparent.

25. The modular ramp system as claimed in claim 1, wherein the modular ramp system comprises a camera attachment means.

26. The modular ramp system as claimed in claim 1, further comprising lighting means operably associated with at least one of the panels.

27. The modular ramp system as claimed in claim 1, wherein the load bearing means is pivotally coupled to the underside of the panel by a biasing arrangement.

28. The modular ramp system as claimed in claim 1, wherein the weight of the modular ramp system including a panel of the multi-sectional ramp deck and an associated load bearing means is in the range of 3kg to 10kg.

* * * * *